United States Patent [19]

Neumann et al.

[11] Patent Number: 4,559,291

[45] Date of Patent: Dec. 17, 1985

[54] LIGANDS FOR METALLIZABLE DYES

[75] Inventors: Stephen M. Neumann, Rochester; Glenn T. Pearce, Fairport; Theophilus Sorrell, Pittsford, all of N.Y.

[73] Assignee: Eastman Kodak Company, Rochester, N.Y.

[21] Appl. No.: 687,311

[22] Filed: Dec. 28, 1984

[51] Int. Cl.[4] ..... G03C 5/54; G03C 1/40

[52] U.S. Cl. ..... 430/214; 430/212; 430/216; 430/218; 430/222; 430/223; 430/491

[58] Field of Search ..... 430/214, 216, 218, 222, 430/223, 212, 491

[56] References Cited

U.S. PATENT DOCUMENTS

| | | | |
|---|---|---|---|
| 3,617,277 | 11/1971 | Stewart | 430/218 |
| 3,856,521 | 12/1974 | Bilofsky et al. | 430/214 |
| 4,030,920 | 6/1977 | Kuh et al. | 430/218 |
| 4,142,891 | 3/1979 | Baigrie et al. | 430/223 |
| 4,148,641 | 4/1979 | Green et al. | 430/223 |
| 4,186,004 | 1/1980 | Deabridges et al. | 430/218 |

*Primary Examiner*—Richard L. Schilling
*Attorney, Agent, or Firm*—Harold E. Cole

[57] ABSTRACT

Photographic assemblages are described employing metallizable redox dye-releasers and a ligand having a coordinating site which is:

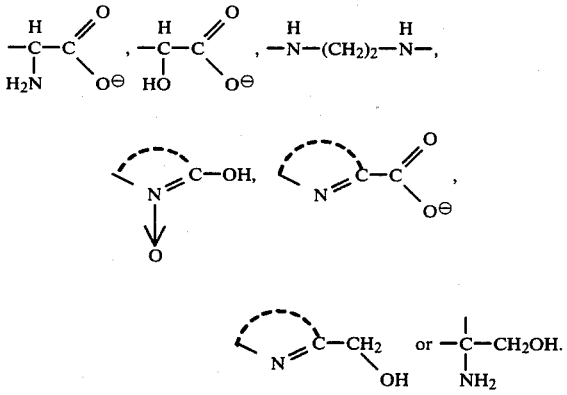

In a preferred embodiment, the ligand is an alpha amino carboxylic acid, a 2-pyridinecarboxylic acid, a 2-aminoalcohol, a 2-hydroxymethylpyridine, a 2-hydroxyacetic acid, a 1,2-diamine or a 2-hydroxypyridine-N-oxide.

28 Claims, No Drawings

LIGANDS FOR METALLIZABLE DYES

This invention relates to photography, and more particularly to photographic assemblages for color diffusion transfer photography employing at least one silver halide emulsion layer and a metallizable, redox dye-releaser (RDR) and wherein a certain ligand is employed, preferably in the processing composition.

Various formats for color, integral transfer elements are described in the prior art, such as U.S. Pat. Nos. 3,415,644; 3,415,645; 3,415,646; 3,647,437; 3,635,707; 3,756,815, and Canadian Pat. Nos. 928,559 and 674,082. In these formats, the image-receiving layer containing the photographic image for viewing remains permanently attached and integral with the image generating and ancillary layers present in the structure when a transparent support is employed on the viewing side of the assemblage. The image is formed by dyes, produced in the image generating units, diffusing through the layers of the structure to the dye image-receiving layer. After exposure of the assemblage, an alkaline processing composition permeates the various layers to initiate development of the exposed photosensitive silver halide emulsion layers. The emulsion layers are developed in proportion to the extent of the respective exposures, and the image dyes which are formed or released in the respective image generating layers begin to diffuse throughout the structure. At least a portion of the imagewise distribution of diffusible dyes diffuse to the dye image-receiving layer to form an image of the original subject.

Metallizable redox RDR's both positive-working and negative-working are desirable in image transfer systems for a variety of reasons. One of the primary reasons for their choice is their exceptional stability to light.

Also desirable in image transfer systems is a short access time. To obtain this, dye must be released rapidly from the RDR along with a rapid migration of the dye to the mordant. In addition, metallization and retention of the dye on the mordant must be efficient. If metallization of the dye occurs slowly on the mordant, there will be an observable hue shift as the process occurs which is objectionable. Further, as the pH of the system is lowered by the action of a neutralization layer, a portion of the dye may be prevented from becoming metallized, which would result in an improper and variable hue with corresponding poorer light stability.

Another problem with metallizable RDR's is the high pH (>12) at which dye metallization occurs. At this pH, many metals form insoluble hydroxides, thus reducing the concentration of free metal ions available for dye metallization which results in slow metallization rates.

It would be desirable to find a way to prevent metal hydroxide formation, yet not hinder the metal from metallizing the dye. While complexation could prevent metal hydroxide formation, a very strong metal complex could prevent dye metallization or markedly increase access time.

In this invention, a ligand is provided that competes effectively with hydroxide for the metal, yet still makes the metal available for reaction with the dye at or near the mordant site to provide effective metallization. One of the advantages of the invention is a decrease in the time required for the metal dye metallization reaction at an image transfer processing of pH 11 or higher.

U.S. Pat. Nos. 3,617,277 and 3,856,521 relate to dye developer diffusion transfer systems employing various metal chelating or complexing agents, such as ethylenediamine tetraacetic acid and nitrilotriacetic acid, to provide various beneficial effects such as cleaner highlights. There is no disclosure in these patents, however, that such materials would be useful in metallizable RDR systems to improve dye metallization.

A photographic film assemblage in accordance with the invention comprises:

(a) a photographic element comprising a support having thereon at least one photosensitive silver halide emulsion layer having associated therewith a metallizable, redox dye-releaser;

(b) a dye image-receiving layer;

(c) an alkaline processing composition and means containing same for discharge within the assemblage, and (d) a transparent cover sheet located over the layer outermost from the support;

the assemblage containing an electron transfer agent and a ligand having a coordinating site which is:

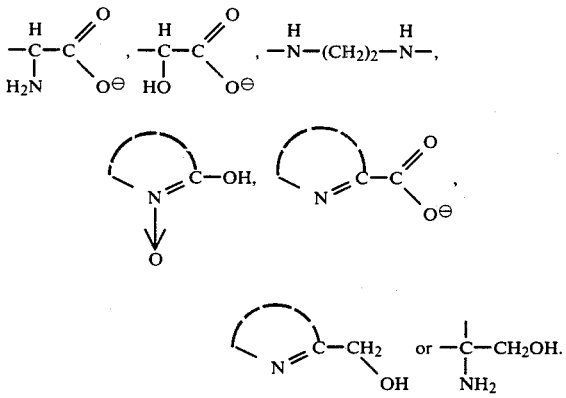

The ligand can be located in any layer of the assemblage as desired. A convenient and preferred location, however, is in the alkaline processing composition.

The ligand can be employed in the assemblage in any concentration which is effective for the intended purpose. When employed in the alkaline processing composition, good results are obtained when the ligand is present at a concentration of from about 1 to about 20 grams per liter of processing composition.

As used in accordance with the invention described herein, these ligands are believed to prevent nickel hydroxide formation yet promote dye metallization with the metal at the mordant site.

In a preferred embodiment of the invention, the following groups of ligands have been found to provide good results:

(a) alpha amino carboxylic acids such as: glycine, (N-(trishydroxymethyl)methylglycine), alanine, phenylalanine, 2-methylalanine, serine, glutamic acid, methionine, ornithine, lysine, triglycine, glutathione, tryptophan, histidine, isoleucine, leucine, valine, threonine, proline, 2-aminobutyric acid, iminodiacetic acid, ethylenediaminediacetic acid, and nitrilotriacetic acid;

(b) 2-pyridinecarboxylic acids such as: 2-pyridinecarboxylic acid, 2,2-pyridinedicarboxylic acid, 2,4-pyridinedicarboxylic acid, 2,5-pyridinedicarboxylic acid, and 2,6-pyridinedicarboxylic acid;

(c) 2-aminoalcohols such as: trishydroxymethylaminomethane, 2-amino-2-methyl-1,3-propanediol, N-(hydroxyethyl)ethylenediamine, 2-diethylaminoethanol, triethanolamine and 2-ethylaminoethanol;

(d) 2-hydroxymethylpyridines such as: 2,6-bis-(hydroxymethyl)-3-pyridinol, 2,6-bis(hydroxymethyl)pyridine and 2,6-bis(hydroxymethyl)-3-(N-isopropylsulfamoyl)pyridine;

(e) 2-hydroxyacetic acids such as: tartaric acid and tartronic acid;

(f) 1,2-diamines such as: ethylenediamine, diethylenetriamine, triethylenetetramine, and N,N-bis(2-aminoethyl)-1,3-propanediamine; and (g) 2-hydroxypyridine-N-oxide.

Any RDR may be employed in this invention as long as it has a metallizable dye moiety. RDR's are well known to those skilled in the art and are, generally speaking, compounds which will react with oxidized or unoxidized developing agent or electron transfer agent to release a dye. The dye moiety of a metallizable RDR contains a metal chelating group such as hydroxy, amino, carboxy, sulfonamido, sulfamoyl, acyl, etc.

In general, RDR's include negative-working compounds as described, for example, in U.S. Pat. Nos. 3,728,113 of Becker et al; 3,725,062 of Anderson and Lum; 3,698,897 of Gompf and Lum; 3,628,952 of Puschel et al; 3,443,939 and 3,443,940 of Bloom et al; 4,053,312 of Fleckenstein; 4,076,529 of Fleckenstein et al; 4,055,428 of Koyama et al; 4,149,892 of Deguchi et al; 4,198,235 and 4,179,291 of Vetter et al; *Research Disclosure* 15157, November, 1976 and *Research Disclosure* 15654, April, 1977, the disclosures of which are hereby incorporated by reference.

In general, RDR's also include positive-working compounds (PRDR's). Such PRDR's are disclosed, for example, in U.S. Pat. Nos. 4,139,379, 4,199,354, 4,232,107, 4,242,435, 4,273,855, 3,980,479 and 4,139,389, the disclosures of which are hereby incorporated by reference. In a preferred embodiment of these PRDR's, an immobile compound is employed which as incorporated in a photosensitive element is incapable of releasing a diffusible dye. However, during photographic processing under alkaline conditions, the compound is capable of accepting at least one electron (i.e., being reduced) and thereafter releases a diffusible dye. These immobile compounds are ballasted, electron accepting nucleophilic displacement compounds.

In a preferred embodiment of this invention, the metallizable RDR is a quinone PRDR and the photographic element contains an incorporated reducing agent as described in U.S. Pat. No. 4,139,379, referred to above. In another preferred embodiment, the quinone PRDR's have the formula:

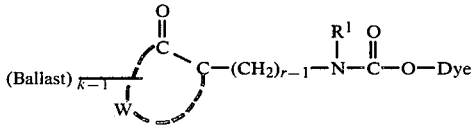

wherein:

Ballast is an organic ballasting radical of such molecular size and configuration as to render the compound nondiffusible in the photographic element during development in an alkaline processing composition;

W represents at least the atoms necessary to complete a quinone nucleus;

r is a positive integer of 1 or 2;

$R^1$ is an alkyl radical having 1 to about 40 carbon atoms or an aryl radical having 6 to about 40 carbon atoms;

k is a positive integer of 1 to 2 and is 2 when $R^1$ is a radical of less than 8 carbon atoms; and Dye is a metallizable organic dye or dye precursor moiety.

Specific metallizable RDR's within the general definition described above, both negative-working and positive-working, are described, for example, in U.S. Pat. Nos. 4,142,891 of Baigrie et al, 4,420,550 of Evans et al, 4,419,435 of Reczek et al, 4,396,546 of Krutak et al, 4,368,249 of Anderson et al, 4,287,292 of Chapman et al, and 4,165,987 of Green et al, the disclosures of which are hereby incorporated by reference.

Any metal can be employed to metallize the RDR as long as it performs the desired function of forming the metal:dye complex. There can be employed, for example, nickel(II), copper(II), zinc(II), platinum(II), cobalt(II) or cobalt(III). A preferred metal for coordination is nickel(II).

In a preferred embodiment of the invention, the silver halide emulsions employed are the conventional, negative-working emulsions well known to those skilled in the art. A positive image will thereby be obtained in the image-receiving layer. Use of a direct-positive emulsion will produce a negative image in the image-receiving layer. Such a negative can be used to produce positive prints if so desired.

The dye image-receiving layer in the above-described film assemblage is optionally located on a separate support adapted to be superposed on the photographic element after exposure thereof. Such image-receiving elements are generally disclosed, for example, in U.S. Pat. No. 3,362,819. In accordance with this embodiment of the invention, the dye image-receiving element would comprise a support having thereon, in sequence, a neutralizing layer, a timing layer and a dye image-receiving layer. When the means for discharging the processing composition is a rupturable container, it is usually positioned in relation to the photographic element and the image-receiving element so that a compressive force applied to the container by pressure-applying members, such as would be found in a typical camera used for in-camera processing, will effect a discharge of the container's contents between the image-receiving element and the outermost layer of the photographic element. After processing, the dye image-receiving element is separated from the photographic element.

A format for integral negative-receiver photographic elements in which the present invention is useful is disclosed in Canadian Pat. No. 928,559. In this embodiment, the support for the photographic element is transparent and is coated with the image-receiving layer, a substantially opaque, light-reflective layer and the photosensitive layer or layers described above. A rupturable container, containing an alkaline processing composition including an electron transfer agent (ETA) and an opacifier, is positioned between the top layer and a transparent cover sheet which has thereon, in sequence, a neutralizing layer and a timing layer. The film unit is placed in a camera, exposed through the transparent cover sheet and then passed through a pair of pressure-applying members in the camera as it is being removed therefrom. The pressure-applying members rupture the container and spread processing composition and opacifier over the negative portion of the film unit to render it light-insensitive. The processing composition develops each silver halide layer and dye images, formed as a result of development, diffuse to the image-receiving layer to provide a positive, right-reading image which is viewed through the transparent support on the opaque reflecting layer background. For further details concerning the format of this particular integral film unit, reference is made to the above-mentioned Canadian Pat. No. 928,559.

Still other useful integral formats in which this invention can be employed are described in U.S. Pat. Nos. 3,415,644; 3,415,645; 3,415,646; 3,647,437 and 3,635,707. In most of these formats, a photosensitive silver halide emulsion is coated on an opaque support and a dye image-receiving layer is located on a separate transparent support superposed over the layer outermost from the opaque support. In addition, this transparent support also contains a neutralizing layer and a timing layer underneath the dye image-receiving layer.

In another embodiment of the invention, the neutralizing layer and timing layer are located underneath the photosensitive layer or layers. In that embodiment, the photographic element would comprise a support having thereon, in sequence, a neutralizing layer, a timing layer and at least one photosensitive silver halide emulsion layer having associated therewith a dye image-providing material. A dye image-receiving layer would be provided on a second support with the processing composition being applied therebetween. This format could either be peel-apart or integral, as described above.

A process for producing a photographic transfer image in color according to the invention from an imagewise exposed photosensitive element comprising a support having thereon at least one photosensitive silver halide emulsion layer having associated therewith a dye image-providing material as described above comprises treating the element with an alkaline processing composition in the presence of a silver halide developing agent or ETA to effect development of each of the exposed silver halide emulsion layers. An imagewise distribution of dye image-providing material is thus formed as a function of development, and at least a portion of it diffuses to a dye image-receiving layer to provide the transfer image.

The film unit or assemblage of the present invention is used to produce positive images in single or multicolors. In a three-color system, each silver halide emulsion layer of the film assembly will have associated therewith a dye-releasing compound which releases a dye possessing a predominant spectral absorption within the region of the visible spectrum to which said silver halide emulsion is sensitive, i.e., the blue-sensitive silver halide emulsion layer will have a yellow dye-releaser associated therewith, the green-sensitive silver halide emulsion layer will have a magenta dye-releaser associated therewith and the red-sensitive silver halide emulsion layer will have a cyan dye-releaser associated therewith. The dye-releaser associated with each silver halide emulsion layer is contained either in the silver halide emulsion layer itself or in a layer contiguous to the silver halide emulsion layer, i.e., the dye-releaser can be coated in a separate layer underneath the silver halide emulsion layer with respect to the exposure direction.

The concentration of the dye-releasing compounds that are employed in the present invention can be varied over a wide range, depending upon the particular compound employed and the results desired. For example, a dye-releaser coated in a layer at a concentration of 0.1 to 3 $g/m^2$ has been found to be useful. The dye-releaser can be dispersed in a hydrophilic film-forming natural material or synthetic polymer, such as gelatin, polyvinyl alcohol, etc, which is adapted to be permeated by aqueous alkaline processing composition.

A variety of silver halide developing agents are useful in this invention. Specific examples of developers on ETA's useful in this invention include hydroquinone compounds, aminophenol compounds, catechol compounds, and 3-pyrazolidinone compounds as disclosed in column 16 of U.S. Pat. No. 4,358,527 issued Nov. 9, 1982. A combination of different ETA's, such as those disclosed in U.S. Pat. No. 3,039,869, can also be employed. These ETA's are employed in the liquid processing composition or contained, at least in part, in any layer or layers of the photographic element or film unit to be activated by the alkaline processing composition, such as in the silver halide emulsion layers, the dye image-providing material layers, interlayers, image-receiving layer, etc.

The various silver halide emulsion layers of a color film assembly employed in this invention can be disposed in the usual order, i.e., the blue-sensitive silver halide emulsion layer first with respect to the exposure side, followed by the green-sensitive and red-sensitive silver halide emulsion layers. If desired, a yellow dye layer or a yellow colloidal silver layer can be present between the blue-sensitive and green-sensitive silver halide emulsion layers for absorbing or filtering blue radiation that is transmitted through the blue-sensitive layer. If desired, the selectively sensitized silver halide emulsion layers can be disposed in a different order, e.g., the blue-sensitive layer first with respect to the exposure side, followed by the red-sensitive and green-sensitive layers.

The rupturable container employed in certain embodiments of this invention is disclosed in U.S. Pat. Nos. 2,543,181; 2,643,886; 2,653,732; 2,723,051; 3,056,492; 3,056,491 and 3,152,515. In general, such containers comprise a rectangular sheet of fluid- and air-impervious material folded longitudinally upon itself to form two walls which are sealed to one another along their longitudinal and end margins to form a cavity in which processing solution is contained.

Generally speaking, except where noted otherwise, the silver halide emulsion layers employed in the invention comprise photosensitive silver halide dispersed together with the dye releaser in gelatin or another aqueous alkaline solution-permeable polymeric binder and are about 0.6 to 7 microns in thickness; and the alkaline solution-permeable polymeric interlayers, e.g., gelatin, are about 0.2 to 5 microns in thickness. Of course, these thicknesses are approximate only and can be modified according to the product desired. The silver halide emulsions and dye releasers may also be coated in separate layers, if desired.

Scavengers for oxidized developing agents can be employed in various interlayers of the photographic elements of the invention. Suitable materials are disclosed on page 83 of the November 1976 edition of *Research Disclosure,* the disclosure of which is hereby incorporated by reference.

Any material is useful as the image-receiving layer in this invention, as long as the desired function of mordanting or otherwise fixing the dye images is obtained. The particular material chosen will, of course, depend upon the dye to be mordanted. Suitable materials are disclosed on pages 80 through 82 of the November, 1976 edition of *Research Disclosure,* the disclosure of which is hereby incorporated by reference.

Use of a neutralizing material in the film assemblages of this invention will usually increase the stability of the transferred image. Generally, the neutralizing material will effect a reduction in the pH of the image layer from about 13 or 14 to at least 11 and preferably 5 to 8 within a short time after treatment with alkali. Suitable materials and their functioning are disclosed on pages 22 and 23 of the July 1974 edition of *Research Disclosure,* and pages 35 through 37 of the July 1975 edition of *Research Disclosure,* the disclosures of which are hereby incorporated by reference.

A timing or inert spacer layer can be employed in the practice of this invention over the neutralizing layer which "times" or controls the pH reduction as a function of the rate at which alkali diffuses through the inert spacer layer. Examples of such timing layers and their functioning are disclosed in the *Research Disclosure* articles mentioned in the paragraph above concerning neutralizing layers.

The alkaline processing composition employed in this invention is the conventional aqueous solution of an alkaline material, e.g., alkali metal hydroxides or carbonates such as sodium hydroxide, sodium carbonate or an amine such as diethylamine, preferably possessing a pH in excess of 11, and also preferably containing a developing agent and a ligand according to the invention, as described previously. Suitable materials and addenda frequently added to such compositions are disclosed on pages 79 and 80 of the November, 1976 edition of *Research Disclosure,* the disclosure of which is hereby incorporated by reference.

The alkaline solution permeable, substantially opaque, light-reflective layer employed in certain embodiments of photographic film units used in this invention is described more fully in the November, 1976 edition of *Research Disclosure,* page 82, the disclosure of which is hereby incorporated by reference.

The supports for the photographic elements used in this invention can be any material, as long as it does not deleteriously affect the photographic properties of the film unit and is dimensionally stable. Typical flexible sheet materials are described on page 85 of the November, 1976 edition of *Research Disclosure,* the disclosure of which is hereby incorporated by reference.

While the invention has been described with reference to layers of silver halide emulsions and dye image-providing materials, dotwise coating, such as would be obtained using a gravure printing technique, could also be employed. In this technique, small dots of blue-, green- and red-sensitive emulsions have associated therewith, respectively, dots of yellow, magenta and cyan color-providing substances. After development, the transferred dyes would tend to fuse together into a continuous tone. In an alternative embodiment, the emulsions sensitive to each of three primary regions of the spectrum can be disposed as a single segmented layer, e.g., as by the use of microvessels as described in Whitmore U.S. Pat. No. 4,362,806 issued Dec. 7, 1982.

The silver halide emulsions useful in this invention, both negative-working and direct-positive ones, are well known to those skilled in the art and are described in *Research Disclosure,* Volume 176, December, 1978, Item 17643, pages 22 and 23, "Emulsion preparation and types"; they are usually chemically and spectrally sensitized as described on page 23, "Chemical sensitization", and "Spectral sensitization and desensitization", of the above article; they are optionally protected against the production of fog and stabilized against loss of sensitivity during keeping by employing the materials described on pages 24 and 25, "Antifoggants and stabilizers", of the above article; they usually contain hardeners and coating aids as described on page 26, "Hardeners", and pages 26 and 27, "Coating aids", of the above article; they and other layers in the photographic elements used in this invention usually contain plasticizers, vehicles and filter dyes described on page 27, "Plasticizers and lubricants"; page 26, "Vehicles and vehicle extenders"; and pages 25 and 26, "Absorbing and scattering materials", of the above article; they and other layers in the photographic elements used in this invention can contain addenda which are incorporated by using the procedures described on page 27, "Methods of addition", of the above article; and they are usually coated and dried by using the various techniques described on pages 27 and 28, "Coating and drying procedures", of the above article, the disclosures of which are hereby incorporated by reference.

The term "nondiffusing" used herein has the meaning commonly applied to the term in photography and denotes material that for all practical purposes do not migrate or wander through organic colloid layers, such as gelatin, in the photographic elements of the invention in an alkaline medium and preferably when processed in a medium having a pH of 11 or greater. The same meaning is to be attached to the term "immobile". The term "diffusible" as applied to the materials of this invention has the converse meaning and denotes materials having the property of diffusing effectively through the colloid layers of the photographic elements in an alkaline medium. "Mobile" has the same meaning as "diffusible".

The term "associated therewith" as used herein is intended to mean that the materials can be in either the same or different layers, so long as the materials are accessible to one another.

The following examples are provided to further illustrate the invention.

EXAMPLE

Because of the many variables involved in a complete multicolor image transfer unit, a single dye model format was used to demonstrate the ligands of the invention. Such a dye would normally be part of an RDR, such as a positive-working RDR, in a multicolor image transfer format such as described in Example 1 of U.S. Pat. No. 4,485,164 of Armour and Munshi, issued Nov. 27, 1984.

The following cyan formazan dye was chosen for evaluation of the ligands of the invention.

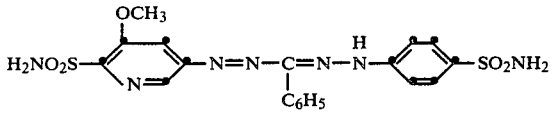

λ-max (unmetallized) (pH 7) 498 nm

λ-max (Ni complex) (pH 7) 662 nm

This dye was selected for two reasons:

(1) It is moderately difficult to metallize and will thus show good reactivity discrimination of various ligands, and (2) The hue of the metallized and unmetallized species is sufficiently different so that dye-metallization may be directly estimated by observing the density at a single wavelength where only the complexed dye absorbs.

Dye coatings were prepared by coating the above cyan dye at 0.14 g/m$^2$ in 3.2 g/m$^2$ of gelatin on a transparent poly(ethylene terephthalate) film support.

Various processing compositions were prepared comprising the following:

| | |
|---|---|
| Potassium hydroxide | 28 g/l |
| Carboxymethylcellulose | 30 g/l |
| Ligand as specified in the Tables below (Invention and Comparison) | 0.29 M |

A receiver coating was prepared consisting of a top layer of 2.2 g/m$^2$ of poly-4-vinylpyridine mordant in 2.2 g/m$^2$ poly(acrylamide-co-N-(3-aminopropyl)methacrylamide) (95:5 weight ratio) and a lower layer of 0.65 g/m$^2$ nickel nitrate hexahydrate in 1.1 g/m$^2$ of the acrylamide copolymer coated on a transparent poly(ethylene terephthalate) film support.

The viscous processing composition was spread between the dye and receiver coatings using a pair of rollers to provide a 100 μm fluid gap. The laminated unit was immediately transferred to a recording spectrophotometer and the transmitted density was monitored at a fixed wavelength, 690 nm, as a function of time. Computer generated density versus time curves were obtained and the time to a given percent (50 percent, 75 percent, and 90 percent) of the final density was calculated. Times less than 10 seconds were not practical to determine. All metallization rates are compared to a control containing no ligand.

The following results were obtained.

TABLE I

Dye Metallization with Aliphatic $-\underset{H_2N}{\overset{H}{C}}-\overset{O}{\overset{\|}{C}}-O^{\ominus}$ Ligands

| Compound Structure | Compound Name | Conc.* | Time (sec) to Given Percent of Final D-max 50% | 75% | 90% |
|---|---|---|---|---|---|
| Control | — | None | 25 | 45 | 65 |
| Invention | | | | | |
| $H_2NCH_2CO_2H$ | Glycine | 2.2 | <10 | <10 | <10 |
| $(HOCH_2)_3C(NH)CH_2CO_2H$ | N—(Tris(hydroxymethyl)-methyl)glycine | 5.2 | <10 | <10 | <10 |
| $CH_3CH(NH_2)CO_2H$ | Alanine | 2.6 | <10 | 15 | 15 |
| $C_6H_5CH_2CH(NH_2)CO_2H$ | Phenylalanine | 4.8 | 10 | 20 | 30 |
| $HOCH_2CH(NH_2)CO_2H$ | Serine | 3.1 | <10 | <10 | <10 |
| $HO_2C(CH_2)_2CH(NH_2)CO_2H$ | Glutamic acid | 4.3 | <10 | 15 | 20 |
| $CH_3S(CH_2)_2CH(NH_2)CO_2H$ | Methionine | 4.4 | 15 | 25 | 40 |
| $H_2N(CH_2)_3CH(NH_2)CO_2H.HCl$ | Ornithine HCl | 4.9 | <10 | <10 | 15 |
| $H_2N(CH_2)_4CH(NH_2)CO_2H$ HCl | Lysine.HCl | 5.3 | 10 | 20 | 30 |
| $H_2NCH_2CONHCH_2CONHCH_2CO_2H$ | Triglycine | 5.5 | 10 | 10 | 10 |
| $HO_2CCH(NH_2)(CH_2)CONHCH—(CH_2SH)CONHCH_2CO_2H$ | Glutathione | 9.0 | 10 | 15 | 15 |
| 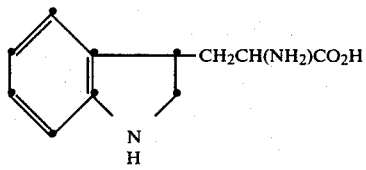 | Tryptophan | 6.0 | 15 | 25 | 40 |
| 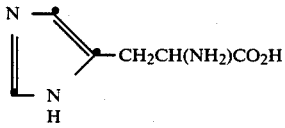 | Histidine | 4.5 | 10 | 10 | 30 |
| $NH(CH_2CO_2H)_2$ | Iminodiacetic acid | 3.9 | 10 | 10 | 20 |
| $(CH_2)NHCH_2CO_2H)_2$ | Ethylenediamine diacetic acid | 5.2 | 15 | 20 | 35 |
| $N(CH_2CH_2CO_2H)_3$ | Nitrilotriacetic acid | 5.6 | 15 | 15 | 30 |
| Comparison | | | | | |
| $(HO_2CCH_2)_2N(CH_2)_2N(CH_2CO_2H)_2$ | Ethylenediamine-tetraacetic acid | 11.8 | 115 | 320 | 570 |
| 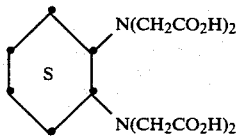 | 1,2-Diaminocyclohexane-N,N,N',N'—tetraacetic acid | 10.6 | 45 | 95 | 175 |

*Concentration of ligand, g/l, in the processing composition. Weights are varied to provide a constant molar concentration of 0.029 M.

The above results indicate that various ligand compounds of the invention having the aliphatic ligand illustrated, are effective in promoting dye metallization as compared to the control processing composition having no ligand compound included therein.

The comparison compounds ethylenediamine tetraacetic acid and 1,2-diaminocyclohexane-N,N,N'N'-tetraacetic acid were particularly poor and greatly hindered dye metallization. It is believed that they form a very stable complex with nickel, thus binding the nickel too strongly and not being able to release it to the dye. This is in contrast to two structurally related compounds of the invention, ethylenediamine diacetic acid and nitrilotriacetic acid, which were very effective in dye metallization.

TABLE II

Dye Metallization with Heterocyclic 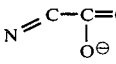 Ligands

| Compound Structure | Compound Name | Conc.* | Time (sec) to Given Percent of Final D-max 50% | 75% | 90% |
|---|---|---|---|---|---|
| (Control) | — | None | 25 | 45 | 65 |
| Invention | | | | | |
| 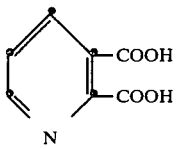 | 2,3-Pyridinedicarboxylic acid | 4.9 | 15 | 25 | 65 |
| 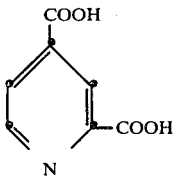 | 2,4-Pyridinedicarboxylic acid | 4.9 | 15 | 20 | 40 |
| 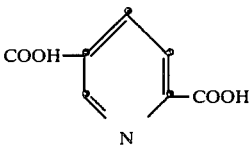 | 2,5-Pyridinedicarboxylic acid | 4.9 | 10 | 20 | 35 |
| 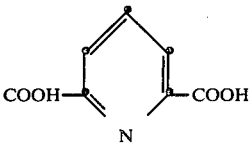 | 2,6-Pyridinedicarboxylic acid | 4.9 | <10 | 15 | 15 |
| Comparison | | | | | |
| 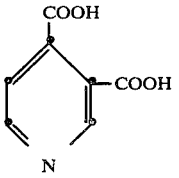 | 3,4-Pyridinedicarboxylic acid | 4.9 | 30 | 60 | 100 |
| 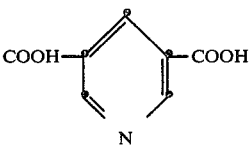 | 3,5-Pyridinedicarboxylic acid | 4.9 | 35 | 60 | 100 |

TABLE II-continued

Dye Metallization with Heterocyclic 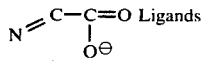 Ligands

| Compound Structure | Compound Name | Conc.* | Time (sec) to Given Percent of Final D-max 50% | 75% | 90% |
|---|---|---|---|---|---|
| 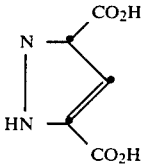 | 3,5-Pyrazoledicarboxylic acid | 4.6 | 20 | 45 | 85 |

*Concentration of ligand, g/l, in the processing composition. Weights are varied to provide a constant molar concentration of 0.029 M.

In this Table, the effectiveness of 2-pyridinecarboxylic acids are demonstrated. When the carboxyl group is remote from the nitrogen electron donor in the 3-position or 4-position as illustrated by the comparison compounds, then dye metallization is hindered.

The data in this Table indicates that compounds based upon 2-hydroxymethylpyridine and 2-aminoethanol are effective for dye metallization. The structurally related comparison compound did not improve dye metallization.

TABLE III

Dye Metallization with Aliphatic 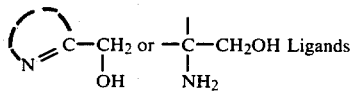 Ligands

| Compound Structure | Compound Name | Conc.* | Time (sec) to Given Percent of Final D-max 50% | 75% | 90% |
|---|---|---|---|---|---|
| (Control) | — | None | 25 | 45 | 65 |
| Invention | | | | | |
| $H_2NC(CH_2OH)_3$ | Trishydroxymethylaminomethane | 3.5 | 10 | 10 | 20 |
| 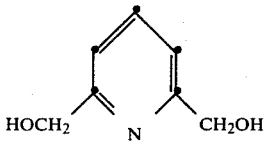 | 2,6-Pyridinedimethanol | 4.1 | 10 | 10 | 10 |
| 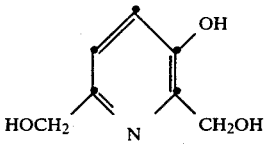 | 2,6-Bis(hydroxymethyl)-3-pyridinol | 4.5 | 10 | 10 | 20 |
| Comparison | | | | | |
| 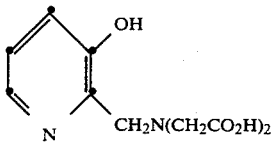 | (3-Hydroxy-2-pyridylmethyl)iminodiacetic acid | 6.2 | 45 | 75 | 125 |

*Concentration of ligand, g/l, in the processing composition. Weights are varied to provide a constant molar concentration of 0.029 M.

TABLE IV

Dye Metallization with Aliphatic 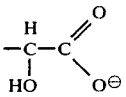 Ligands

| Compound Structure | Compound Name | Conc.* | Time (sec) to Given Percent of Final D-max 50% | 75% | 90% |
|---|---|---|---|---|---|
| (Control) | — | None | 25 | 45 | 65 |
| Invention | | | | | |
| $HO_2C(CHOH)_2CO_2H$ | Tartaric acid | 4.4 | 10 | 10 | 18 |
| $HOCH(CO_2H)_2$ | Tartronic acid | 3.5 | 10 | 30 | 60 |
| Comparison | | | | | |
| $HOCH_2CO_2H$ | Glycolic acid | 2.2 | 25 | 50 | 85 |
| $CH_3CHOHCO_2H$ | Lactic acid | 2.6 | 20 | 35 | 60 |
| $HO_2CCH_2CHOHCO_2H$ | Malic acid | 3.9 | 25 | 50 | 80 |
| $HOC(CO_2H)_3$ | Citric acid | 5.6 | 15 | 25 | 90 |
| $HO_2CC(OH_2)C(OH)_2CO_2H$ | Tetrahydroxysuccinic | 6.6 | 35 | 90 | 265 |
| $C_6H_5CHOHCO_2H$ | Mandelic acid | 4.4 | 20 | 35 | 55 |
| 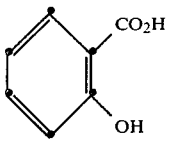 | Salicylic acid | 4.0 | 20 | 35 | 50 |

*Concentration of ligand, g/l, in the processing composition. Weights are varied to provide a constant molar concentration of 0.029 M.

The compounds in this Table having the ligand group illustrated were effective in at least two out of three D-max percentages in improving dye metallization, as compared to the comparison compounds which are structurally similar.

TABLE V

Dye Metallization with Other Ligands

| Compound Structure | Compound Name | Conc.* | Time (sec) to Given Percent of Final D-max 50% | 75% | 90% |
|---|---|---|---|---|---|
| (Control) | — | None | 25 | 45 | 65 |
| Invention | | | | | |
| $H_2NCH_2CH_2NH_2$ | Ethylenediamine | 1.8 | <10 | <10 | <10 |
| $H_2N(CH_2)NH(CH_2)_2NH(CH_2)_2NH_2$ | Triethylenetetramine | 4.2 | 10 | 25 | 35 |
| $H_2N(CH_2)_2NH(CH_2)_3NH(CH_2)_2NH_2$ | N,N—bis(2-aminoethyl)-1,3-propanediamine | 4.7 | <10 | <10 | 25 |
| 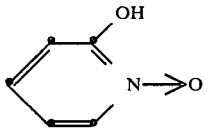 | 2-Hydroxypyridine-N—oxide | 3.2 | 15 | 25 | 35 |
| Comparison | | | | | |
| $C_6H_5N$ | Pyridine | 2.3 | 30 | 50 | 80 |
| $NH_4OH$ | Ammonium hydroxide | 1.0 | 20 | 35 | 60 |
| $C_6H_5CH_2N^+(C_2H_5)_3Cl^-$ | Benzyltriethylammonium chloride | 6.7 | 30 | 55 | 90 |
| $CH_3(C{=}NOH)_2CH_3$ | Dimethylgloxime | 3.4 | 70 | 160 | 290 |
| $HO_2C(CH_2)_2CO_2H$ | Succinic acid | 3.5 | 35 | 65 | 110 |
| $HO_2CCH_2(CH_2CO_2H)_2$ | 1,2,3-Propanetricarboxylic acid | 4.9 | 45 | 90 | 155 |
| $HO_2CCH_2OCH_2COOH$ | Diglycolic acid | 3.9 | 40 | 70 | 110 |
| 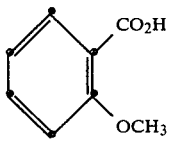 | o-Methoxybenzoic acid | 4.4 | 25 | 50 | 80 |

TABLE V-continued

Dye Metallization with Other Ligands

| Compound Structure | Compound Name | Conc.* | Time (sec) to Given Percent of Final D-max 50% | 75% | 90% |
|---|---|---|---|---|---|
| 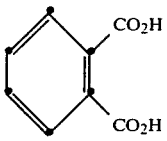 | Phthalic acid | 4.9 | 35 | 60 | 100 |
| $HOCH_2CHOHCH_2OH$ | Glycerol | 2.7 | 25 | 45 | 75 |
| $CH_3COCH_2COCH_3$ | 2,4-Pentanedione | 2.9 | 30 | 50 | 80 |
| $Na_5P_3O_{10}$ | Pentasodiumtriphosphate | 10.7 | 40 | 80 | 140 |
| $CH_2(PO_3H_2)_2$ | Methylenephosphonic acid | 5.1 | 40 | 95 | 190 |
| $(HOCH_2)_2CHO_2P(ONa)_2$ | β-Glycerophosphonic acid. disodium salt | 8.9 | 25 | 50 | 80 |
| $(C_3H_3N_2)_2BHK$ | Bispyrazoleborate. potassium salt | 5.4 | 40 | 70 | 105 |

*Concentration of ligand, g/l, in the processing composition. Weights are varied to provide a constant molar concentration of 0.029 M.

The data in this Table illustrate the effectiveness of other compounds of the invention having miscellaneous other ligand structures. The comparison compounds in this Table, which in many instances strongly hinder dye metallization, are informative in showing the specificity of the invention. These compounds have a variety of functional groups such as auxilliary bases, quaternary salts, hydroxylamines, polybasic acids, aromatic carboxylic acids, glycols, diones, phosphates and borates.

The invention has been described in detail with particular reference to preferred embodiments thereof, but it will be understood that variations and modifications can be effected within the spirit and scope of the invention.

What is claimed is:

1. In a photographic assemblage comprising:

(a) a photographic element comprising a support having thereon at least one photosensitive silver halide emulsion layer having associated therewith a metallizable redox dye-releaser;

(b) a dye image-receiving layer;

(c) an alkaline processing composition and means containing same for discharge within said assemblage; and (d) a transparent cover sheet located over the layer outermost from said support;

said assemblage containing an electron transfer agent; the improvement wherein said assemblage also contains a ligand for preventing metal hydroxide formation and providing effective metallization of the dye released from said metallizable redox dye-releaser, said ligand having a coordinating site which is:

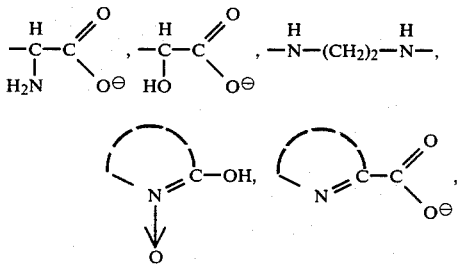

-continued

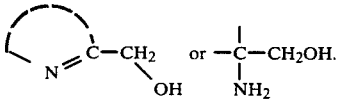

2. The assemblage of claim 1 wherein said ligand is present in said alkaline processing composition.

3. The assemblage of claim 2 wherein said ligand is an alpha amino carboxylic acid, a 2-pyridinecarboxylic acid, a 2-aminoalcohol, a 2-hydroxymethylpyridine, a 2-hydroxyacetic acid, a 1,2-diamine or a 2-hydroxypyridine-N-oxide.

4. The assemblade of claim 3 wherein said ligand is an alpha amino carboxylic acid.

5. The assemblage of claim 4 wherein said alpha amino carboxylic acid is glycine, [N-(trishydroxymethyl)methylglycine], alanine, phenylalanine, 2-methylalanine, serine, glutamic acid, methionine, ornithine, lysine, triglycine, glutathione, tryptophan, histidine, isoleucine, leucine, valine, threonine, proline, 2-aminobutyric acid, iminodiacetic acid, ethylenediaminediacetic acid, or nitrilotriacetic acid.

6. The assemblage of claim 3 wherein said ligand is a 2-pyridinecarboxylic acid.

7. The assembalge of claim 6 wherein said 2-pyridinecarboxylic acid is 2-pyridinecarboxylic acid, 2,3-pyridinedicarboxylic acid, 2,4-pyridinedicarboxylic acid, 2,5-pyridinedicarboxylic acid, or 2,6-pyridinedicarboxylic acid.

8. The assemblage of claim 3 wherein said ligand is a 2 aminoalcohol.

9. The assemblage of claim 8 wherein said 2-aminoalcohol is trishydroxymethylaminomethane, 2-amino-2-methyl-1,3-propanediol, N-(hydroxyethyl)-ethylenediamine, 2-diethylaminoethanol, triethanolamine or 2-ethylaminoethanol.

10. The assemblage of claim 3 wherein said ligand is a 2-hydroxymethylpyridine.

11. The assemblage of claim 10 wherein said 2-hydroxymethylpyridine is 2,6-bis(hydroxymethyl)-3-pyridinol, 2,6-bis(hydroxymethyl)pyridine and 2,6-bis(-hydroxymethyl)-3-(N-isopropylsulfamoyl)-pyridine.

12. The assemblage of claim 3 wherein said ligand is a 2-hydroxyacetic acid.

13. The assemblage of claim 12 wherein said 2-hydroxyacetic acid is tartaric acid or tartronic acid.

14. The assemblage of claim 3 wherein said ligand is a 1,2-diamine.

15. The assemblage of claim 14 wherein said 1,2-diamine is ethylenediamine, diethylenetriamine, triethylenetetramine or N,N-bis(2-aminoethyl)-1,3-propanediamine.

16. The assemblage of claim 3 wherein said ligand is 2-hydroxypyridine-N-oxide.

17. The assemblage of claim 3 wherein said ligand is phenylalanine.

18. The assemblage of claim 1 wherein said metallizable redox dye-releaser is a positive-working, quinone redox dye-releaser and said photographic element contains an incorporated reducing agent.

19. The assemblage of claim 18 wherein said quinone redox dye-releaser has the formula:

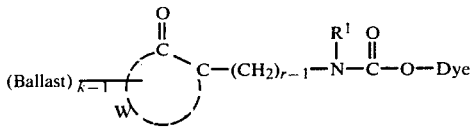

wherein:

Ballast is an organic ballasting radical of such molecular size and configuration as to render said compound nondiffusible in said photographic element during development in said alkaline processing composition;

W represents at least the atoms necessary to complete a quinone nucleus;

r is a positive integer of 1 or 2;

$R^1$ is an alkyl radical having 1 to about 40 carbon atoms or an aryl radical having 6 to about 40 carbon atoms;

k is a positive integer of 1 to 2 and is 2 when $R^1$ is a radical of less than 8 carbon atoms; and Dye is a metallizable organic dye or dye precursor moiety.

20. The assemblage of claim 1 wherein said dye image-receiving layer is located between said support and said silver halide emulsion layer.

21. The assemblage of claim 20 wherein said transparent cover sheet is coated with, in sequence, a neutralizing layer and a timing layer.

22. The assemblage of claim 21 wherein said discharging means is a rupturable container containing said alkaline processing composition and an opacifying agent, said container being so positioned during processing of said assemblage that a compressive force applied to said container will effect a discharge of the container's contents between said cover sheet and the layer outermost from said support.

23. The assemblage of claim 1 wherein said support having thereon said silver halide emulsion layer is opaque, and said dye image-receiving layer is located on said transparent cover sheet and is a dye image-receiving element.

24. The assemblage of claim 23 wherein said dye image-receiving element has thereon, in sequence, a neutralizing layer, a timing layer, and said dye image-receiving layer.

25. The assemblage of claim 23 wherein said opaque support has thereon, in sequence, a neutralizing layer, a timing layer and said silver halide emulsion layer.

26. The assemblage of claim 1 wherein said photographic element comprises a support having thereon a red-sensitive, negative-working, silver halide emulsion layer having a metallizable, ballasted, positive-working, cyan redox dye-releaser associated therewith; a green-sensitive, negative-working, silver halide emulsion layer having a metallizable, ballasted, positive-working, magenta redox dye-releaser associated therewith; and a blue-sensitive, negative-working, silver halide emulsion layer having a ballasted, metallizable, positive-working, yellow redox dye-releaser associated therewith.

27. In an integral photographic assemblage comprising:

(a) a photographic element comprising a transparent support having thereon the following layers in sequence: a dye image-receiving layer; an alkaline solution-permeable, light-reflective layer; an alkaline solution-permeable, opaque layer; a red-sensitive, negative-working, silver halide emulsion layer having a metallizable, ballasted, positive-working, cyan redox dye-releaser associated therewith; a green-sensitive, negative-working, silver halide emulsion layer having a metallizable, ballasted, positive-working, magenta redox dye-releaser associated therewith; and a blue-sensitive, negative-working, silver halide emulsion layer having a metallizable, ballasted, positive-working, yellow redox dye-releaser associated therewith;

(b) a transparent cover sheet superposed over said blue-sensitive silver halide emulsion layer and comprising a transparent support coated with, in sequence, a neutralizing layer and a timing layer; and (c) a rupturable container containing an alkaline processing composition including an electron transfer agent and an opacifying agent, said container being so positioned during processing of said assemblage that a compressive force applied to said container will effect a discharge of the container's contents between said transparent sheet and said blue-sensitive silver halide emulsion layer;

the improvement wherein said assemblage also contains a ligand for preventing metal hydroxide formation and providing effective metallization of the dye released from said metallizable redox dye-releaser, said ligand having a coordinating site which is:

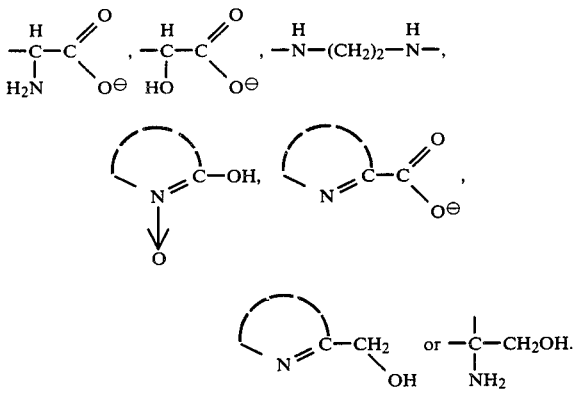

28. The assemblage of claim 27 wherein said ligand is present in said alkaline processing composition.

* * * * *